United States Patent [19]

Young, Jr.

[11] Patent Number: 4,578,845

[45] **Date of Patent: * Apr. 1, 1986**

[54] WEB EDGE DECURLING DEVICE

[75] Inventor: William O. Young, Jr., Spartanburg, S.C.

[73] Assignee: Young Engineering, Inc., Spartanburg, S.C.

[ * ] Notice: The portion of the term of this patent subsequent to May 15, 2001 has been disclaimed.

[21] Appl. No.: 390,632

[22] Filed: Jun. 21, 1982

Related U.S. Application Data

[63] Continuation-in-part of Ser. No. 273,084, Jun. 12, 1981, Pat. No. 4,447,937.

[51] Int. Cl.[4] ..... D06C 25/00

[52] U.S. Cl. ..... 26/98

[58] Field of Search ..... 26/98, DIG. 1, 105; 139/292, 293; 38/143

[56] References Cited

U.S. PATENT DOCUMENTS

| | | | |
|---|---|---|---|
| 459,235 | 9/1891 | Windle | 26/98 X |
| 1,568,401 | 1/1926 | Griffith | 38/143 UX |
| 2,818,087 | 12/1957 | Nichols | 139/293 |
| 3,268,142 | 8/1966 | Macomson | 26/105 X |
| 4,217,682 | 8/1980 | Young, Jr. et al. | 26/98 |
| 4,447,937 | 5/1984 | Young, Jr. | 26/98 |

FOREIGN PATENT DOCUMENTS

| | | | |
|---|---|---|---|
| 1552617 | 11/1968 | France | 139/293 |
| 461403 | 10/1968 | Switzerland | 139/293 |
| 27503 | of 1907 | United Kingdom | 26/DIG. 1 |
| 644987 | 10/1950 | United Kingdom | 26/DIG. 1 |

*Primary Examiner*—Robert R. Mackey

*Attorney, Agent, or Firm*—Dority & Manning

[57] ABSTRACT

A device for removing curl, folds and the like from a moving web in which opposing banks of elongate fins cooperate to define a web passageway therebetween. The banks of fins are preferably associated with top and bottom plates, respectively, that may be biasable apart by seams, etc., passing therebetween, and may include quick release coupling to facilitate assembly and disassembly of the device without affecting the process with which the device is employed. Relative positions of the top and bottom banks of fins may be adjustably controlled. Preferred different fin spacing permits the handling of webs of varying weights and construction. Fin banks are of unitary construction from material exhibiting a low coefficient of friction as exemplified by ultra high molecular weight polyethylene.

23 Claims, 10 Drawing Figures

WEB EDGE DECURLING DEVICE

CROSS REFERENCE TO RELATED APPLICATION

This application is a continuation-in-part of application, Ser. No. 273,084, filed June 12, 1981, in the name of William O. Young, Jr. and entitled "Improved Web Edge Decurling Device" now U.S. Pat. No. 4,447,937, issued May 15, 1984.

BACKGROUND OF THE INVENTION

Textile webs in general are subject to curling along an edge or selvage thereof while being handled in open width and often develop curls, pressed folds or creases therealong due to improper handling, web tension, or the like. Knit or other flimsy textile webs in particular, when processed or handled at low tension or generally tensionless conditions tend to curl or roll up along the selvage. In order to produce a good quality roll of a textile web, or to achieve proper web handling along a process line for printing, inspection, drying, extraction of moisture, washing, doubling, tacking or other web treatment, it is most desirable, if not necessary, to ensure that the web is maintained in a flat condition where little or no fabric deformation is present at either selvage during winding or processing as set forth above. Proper package preparation or web handling may thus be achieved in conjunction with apparatus of the present invention that engages the web selvage and due to a particular action, removes curl, folds and creases from the selvage of the web. While the device of the present invention is suitable for curl, fold and crease removal, hereinafter, decurling is intended to refer to all.

Several different classes of decurling devices have heretofore been developed that include static as well as power driven approaches. Among the power approaches to decurling, exemplary of same are a driven type where oppositely opposed discs, rotating fingers, screws, belts or the like are located along a selvage of the web. The elements are driven to produce a motion which, in turn, imparts a spreading effect to the web to remove the curl. Likewise, fluid jets have been directed against the web curl to apply a decurling or uncurling force thereon. The power driven approach to decurling of necessity, requires a motive force for driving the particular decurling elements. Such obviously adds to cost of operation and likewise, leads to the necessity for continuing maintenance and replacement of parts, not to mention a significant initial capital cost.

The improved decurling device of the present invention is a static type structure. Known static systems include principally the decurler described in U.S. Pat. No. 4,217,682 to Young et al over which the present invention represents improvement. The Young et al web edge decurler has been commercially successful and performs the decurling operation in a very suitable fashion. Likewise a similar static structure utilizes fins that are secured to opposed plates, with the fins defining helices along the length of same, or starting at a flat flange and turning to a generally vertical fin for the effective length of the structure, and a web passageway is defined between the fins for removing curl, etc. from a moving web. Other known static systems include a pair of spring loaded elements that are disposed above and below the web, with each of the elements being U-shaped where a short leg of the U is presented on the web side and engages the web to strip curl therefrom.

Still further, another known static structure includes a planar surface having ridges disposed thereon over which the web passes, with frictional forces produced between the web and the ridges to remove curl from the selvage of the web. Other decurling devices are disclosed in British Pat. No. 105,895 to Canby et al, British Pat. No. 117,427 to Greenwood, and German Pat. No. 276,759 to Spuhr.

Decurling devices according to teachings of the present invention represent a definite technological advance in the art which is not believed to be taught or suggesed by any of the prior art set forth above, or by any other known prior art.

SUMMARY OF THE INVENTION

It is an object of the present invention to provide a device for removing curl, folds and the like from the edge of a moving web.

Another object of the present invention is to provide an improved static device for flattening the selvage of a traveling web to provide a uniform web surface thereat.

Yet another object of the present invention is to provide an improved device for decurling an edge of a moving web that may be positioned immediately adjacent further processing equipment.

Still another object of the present invention is to provide an improved edge decurling device that is uniquely adjustable and is capable of removing all types of curl from the selvage of a wide range of fabrics.

Another object of the present invention is to provide an edge decurling device that includes a unique fin arrangement.

Still another object of the present invention is to provide an improved edge decurling device that may be quickly and easily disassembled to facilitate cleaning and/or inspection of same when necessary.

Yet another object of the present invention is to provide an improved web decurler that is suitable for use in conjunction with a tenter frame and which will accept seams in the fabric being handled without disturbing the tentering operation.

Generally speaking, the device of the present invention for removing curl, folds, and the like from an edge of a moving web comprises a first bank of parallel, elongated fins, said fin bank being of unitary structure that exhibits low friction characteristics, said fins being diposed at an angle to an edge of a web traveling thereby, and having generally flat outer free edge surfaces for contact with a web; a second bank of parallel elongated fins, said second fin bank being of unitary structure that exhibits low friction characteristics and being diposed with respect to said first fin bank to define a web passageway therebetween, fins of said second fin bank being disposed at an angle to an edge of a web traveling thereby, and having generally flat outer free edge surfaces for contact with a web; and means for mounting said banks of fins in said disposition, whereby said generally flat edge surfaces of said fins of said first and second banks cooperate to remove curl, folds, and the like from a web passing therebetween.

More specifically, the banks of fins are preferably removably securable to respective plates, which plates are adjustably associated to present the fin edges at predetermined locations to define a particular web passageway. Preferably, the association of the plates is by means of quick release coupling such that the top and bottom plates may be easily and quickly disassembled for cleaning, inspection or other desirable reasons followed by easy recoupling, with a minimum of disruption of process equipment with which the unit is being utilized.

One embodiment of the instant decurler device includes fins arranged to accommodate a wide range of fabric weights and constructions. Particularly, such embodiment includes providing a plurality of banks of fins with different spacing between fins in at least certain of the banks. A first or entrance pair of opposing banks of fins is provided having fin spacings adequate to accept heavy type webs and initiate decurling of same while also being close enough together to have some initial decurling effect on lighter types of fabric webs. At the exit from the decurler, a pair of opposing banks of fins is provided with lesser space between the fins to complete the decurling action for both types of webs. Preferably for tenter frame applications, the pair of opposing banks of fins are separated by an opening in the respective plates, and through which a sensing mechanism may detect the presence or absence of an edge of the web being decurled. Proper positional location of the web with respect to the pins or clips of the tenter may thus be detected.

The adjustment feature of the present invention preferably includes a plurality of elements or studs associated with one of the bottom or top fin bank receiving plates which make contact with the other of said fin receiving plates. The elements are adapted for movement to and from the plate with which they are associated to vary the spacing between the plates, and thus define the web passageway between the fins according to the dictates of the material being processed. The adjustment studs are preferably received in a housing secured to one of the plates with an opposite end of at least certain of the studs being receivable in appropriate receiving means at the other of said plates whereby relative lateral movement between the two plates is precluded. In a most preferred arrangement, the adjustment studs are received in a housing secured to the inside surface of the top plate, with each of the studs being received in an appropriate opening within the housing, a portion of which is threaded, and wherein a portion of the length of the stud is threaded for mating engagement with the threaded portion of the housing. The studs may all be interengaged by virtue of a drive means making contact therewith, with one of the studs passing through the top plate and being adapted for manual adjustment thereat. Once manual adjustment is made to the one stud, all of the interrelated studs in the housing are simultaneously adjusted by a like amount. Three such studs may be provided in a triangular pattern with two of the studs located on a line parallel to an outer edge of the decurler and the third, manually adjustable stud being located on a line with one of the first two studs, generally parallel to an entrance to the decurling unit.

In one embodiment of the quick release coupling means for the decurler of the present invention, an elongated element is received through one of the two plates, preferably the top plate, and has a spring means located between the outer surface of the plate and an outer end of the element. An element receiving means is presented at an opposite location on the inside of the other plate. When the plates are brought into proper alignment, the elongated element may be depressed against the bias of the spring means, received in the element receiving means in releasable locking engagement, to interlock the top and bottom plates. Disassembly of the top and bottom plates would follow the reverse, i.e., depression of the elongated element in a direction of the plate and manipulation to release same from the receiving means, whereby the two plates may be easily and quickly separated for cleaning, inspection, changing of fin arrangement, or the like. Preferably in such arrangement, the connector means are located adjacent the adjustment means, at an outer end of the decurler, with the other or opposite end of the decurler being devoid of internal support. With the coupling means thus located, the top plate of the device, along the operative length of the decurler, in effect, floats above the bottom plate and is biasable apart from the bottom plate by seams or other imperfections in the web that pass through the device, without interfering with the operation of the device or of processing equipment in connection with which the device is being employed.

The unitary fin banks of the present invention are preferably produced of a material that exhibits low friction characteristics. Exemplary, without limitation, of such polymeric materials are ultra high molecular weight polyethylene and polytetrafluoroethylene. Such polymeric materials should of course exhibit a low coefficient of friction while not being susceptible to abrasion due to web contact, or affected by process temperature, chemical finishes on the web, chemical baths for the web, or the like. Preferably a block of ultra high molecular weight polyethylene is machined to produce the fin bank. Machining may be closely controlled to produce the desired angular fin arrangement, canting of the fins, fin spacing, parallelity of the fins, and the like. Additionaly, by machining, outer free edges of the individual fins, the fins in the bank may be generally flattened, producing a sharp leading tip or apex for each fin for improved removal of curl and the like from a web without cutting the web or any significant amount of fibers from the web. While a machined fin bank is generally preferred, other production techniques for manufacture of the unitary fin bank may likewise be employed, such as molding and the like.

Mounting of the fin banks to the plates or other support structure is preferably accomplished by provision of interrelating elements and snap fit connections that rely upon flexibility of the material from which the bank is manufactured. Such mounting techniques for the fins allows quick assembly and disassembly such that different fin arrangements to be employed for the same plate arrangements, if desirable or necessary, due to particular fabric construction. Particularly, mating groove-protrusion guide arrangements are preferably employed with the fin bank, overriding a protruding stud which snap fits into a mating slot for same.

DESCRIPTION OF PREFERRED EMBODIMENTS

Figure 1:
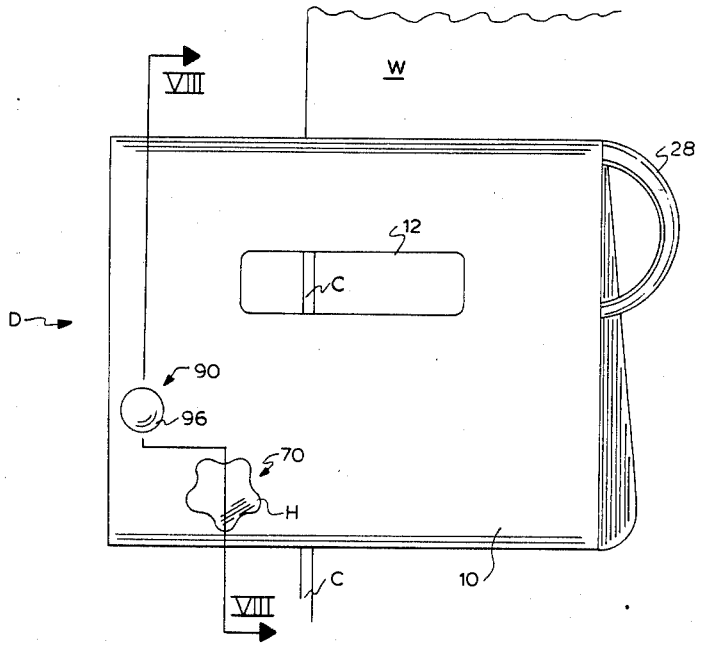
FIG. 1 is a top plan view of a decurling device according to teachings of the present invention.

Making reference to the Figures, preferred embodiments of the present invention will now be described in detail. Operationally speaking, two decurler units D may be located along opposite sides of a passageway for a web W of textile material illustrated for one side only in FIG. 1. Decurler units D may be mounted by means illustrated in FIG. 2 as described hereinafter, or by any other suitable means. Web edge detector means P may be located along at least one of the outer edges of said passageway (see FIG. 2), such that when utilized in conjunction with means to move the web in a lateral direction upon receipt of a signal from the detector means P, the web may be generally maintained properly with respect to the operative decurling zone of units D for removal of curl C from web W.

In FIGS. 1–8, one preferred embodiment of the decurler unit of the present invention is set forth. The decurling device D of the present invention generally includes a top plate 10 having one or more banks of fins associated with an inside surface of same and a bottom plate 20 having one or more banks of fins associated with an inside surface of same. Plates 10 and 20 are thus associated to position the respective fin banks in opposed relationship such that a web passageway is defined therebetween. Preferably plates 10 and 20 are joined by quick release coupling means generally 90. Adjustment means generally 70 are also provided to vary the spacing between the opposing fin banks. Fins making up the fin banks are presented at an angle to a passageway for web W through device D, extending towards an outer edge of device D. When plates 10 and 20 are associated such that the banks of fins are opposed, a web passageway is defined therebetween, as set forth above, through which web W may pass for removal of curl, folds, creases and the like C therefrom.

Figure 3:
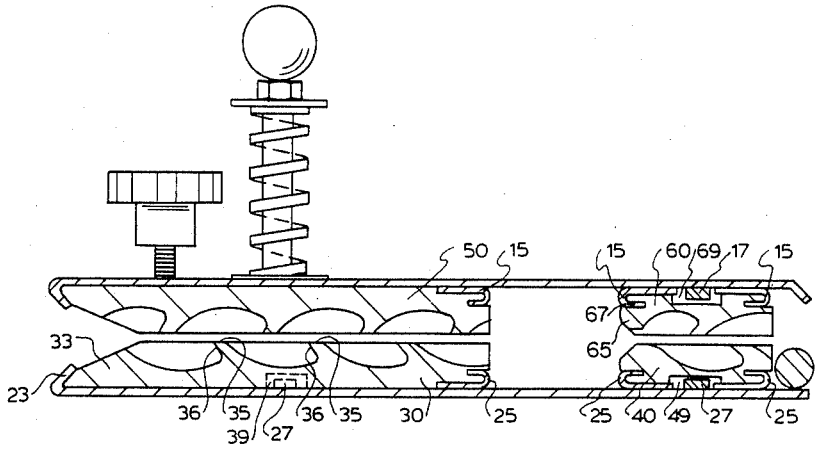
FIG. 3 is a vertical cross sectional view of the decurler as illustrated in FIG. 2, taken along a line III—III.
Figure 4:
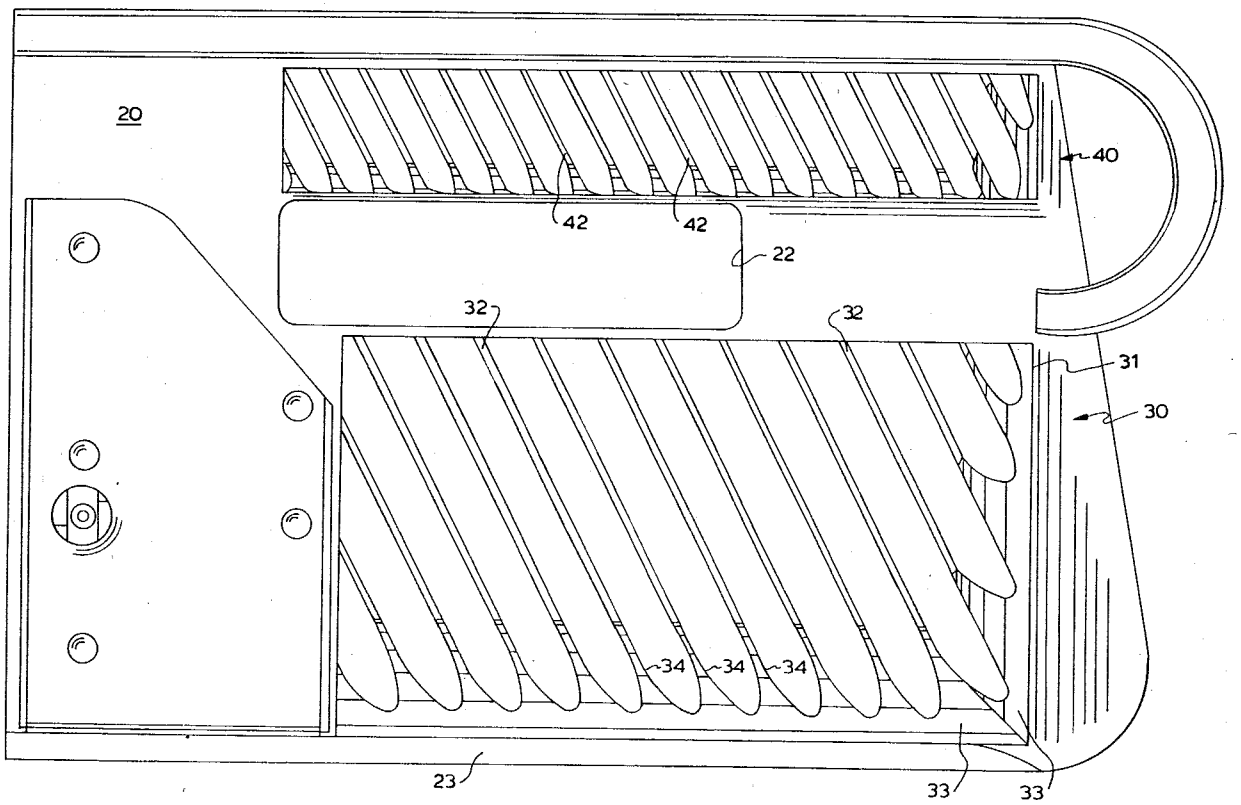
FIG 4 is a plan view of the inside of the bottom plate of a preferred embodiment of the present invention with fin banks secured thereto.
Figure 5:
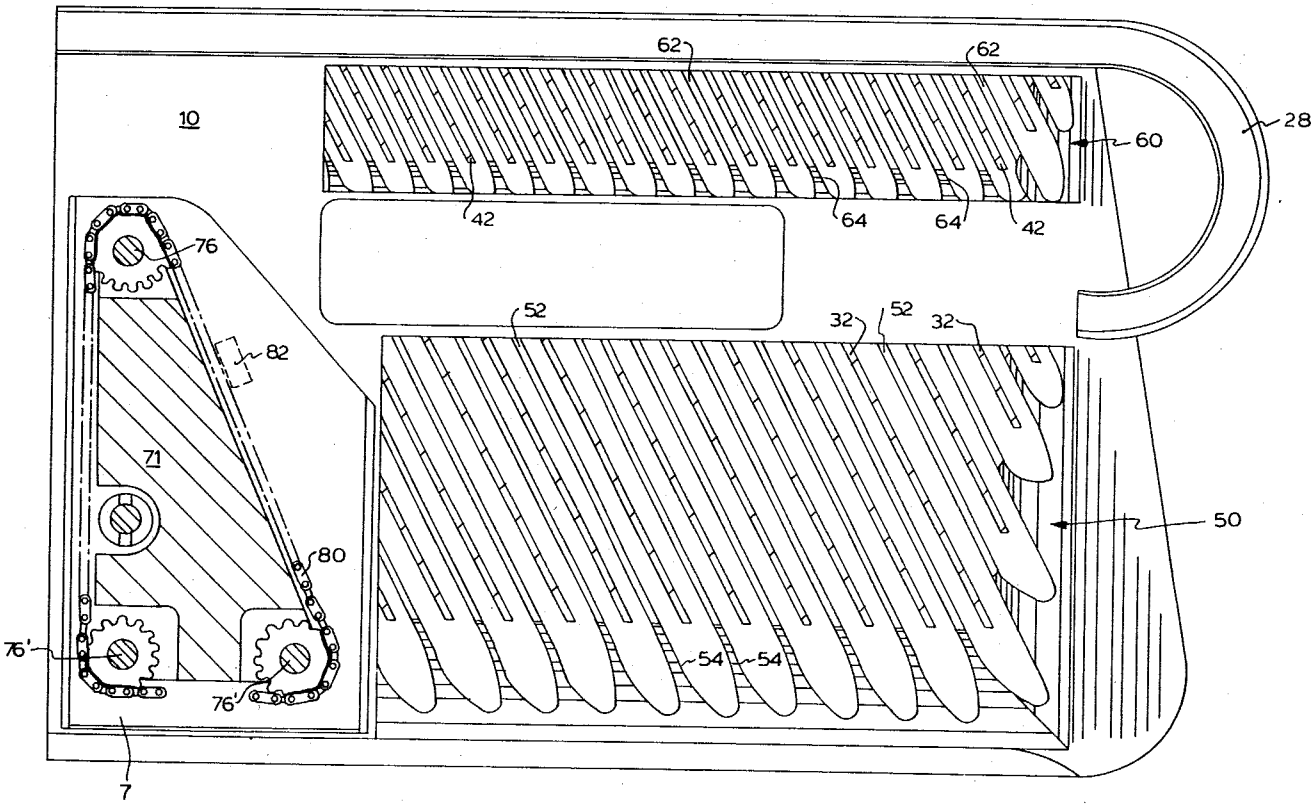
FIG. 5 is a horizontal cross sectional view of the device as illustrated in FIG. 2, taken along a line V—V.

As particularly illustrated in FIG. 4, which is a plan view of bottom plate 20, two fin banks generally 30 and 40 are shown associated therewith on opposite sides of opening 22, each having a plurality of fins 32 and 42, respectively, all of which extend in an angular direction towards an outer edge of the web passageway, with each fin being spaced apart from an adjacent fin by a predetermined distance. Two fin banks 50 and 60 are also associated with the inside of upper plate 10 (See FIG. 5), likewise including a plurality of fins 52 and 62, respectively, which, when superimposed above fin groups 30 and 40 extend angularly outwardly towards an outer edge of the web passageway. In a most preferred embodiment as illustrated in FIGS. 3 and 5, fins 32 and 42 when superimposed above fins 52 and 62 are vertically offset therefrom. A tortuous passageway may be provided through the decurler unit where the vertical spacing between fins of the respective plates is such that the fins intermesh. With a fin bank arrangement of the type illustrated in FIGS. 4 and 5, webs of varying weights and constructions may be processed therethrough. Fins 32 and 52 at the entrance to the device are spaced apart from adjacent fins 32 and 52 at a distance that will initiate a decurling action for both light and heavy webs, while fins 42 and 62 located at the exit end of the device have a lesser spacing to finalize the decurling action.

Figure 6:
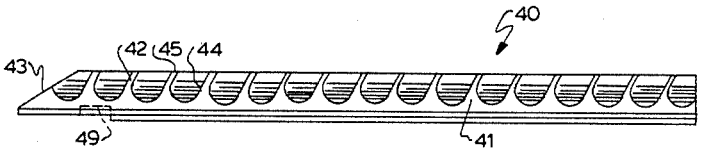
FIG. 6 is a side elevational view of a fin bank according to the teachings of the present invention as viewed from the exit side of the device shown in FIG. 4.
Figure 6A:
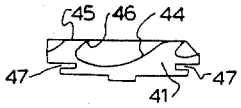
FIG. 6A is an end view of the fin bank as shown in FIG. 6.
Figure 7:
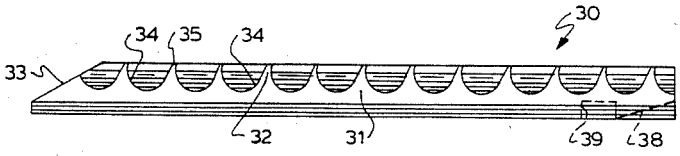
FIG. 7 is a side elevational view of a further fin bank according to teachings of the present invention as viewed from the entrance side of the device as shown in FIG. 4.
Figure 7A:
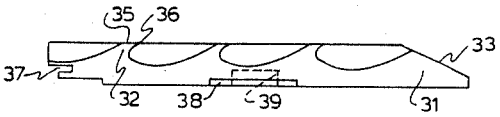
FIG. 7A is an end elevational view of the fin bank as shown in FIG. 7.

Further making reference to FIGS. 4, 5, 6, 6A, 7 and 7A, the specifically illustrated and preferred fin arrangement of the present invention will be described. Fin bank 30 includes a base of ultra high molecular weight polyethylene material 31 having forward and side bevel sections 33. A plurality of parallel grooves 34 are provided in base 31, with fins 32 being defined therebetween. As best seen in FIGS. 3 and 6, fins 32 are preferably canted, and when mounted to plate 20 cant in the web edge direction. The outer free edges 35 of fins 32 (See FIGS. 3, 6, and 7) are generally flat and an apex 36 is provided at the leading edge of same. An underside of base 31 of fin bank 30 is provided with means for removable securement to plate 20, such as beveled edge 33 which resides under flange 23 of plate 20 and a guide slot 37 which mates with a further inturned flange 25 which is secured to plate 20 adjacent opening 22. Additionally, plate 20 is provided with an upstanding stud 27 which is secured to the inside surface of same. Stud 27, during installation of fin bank 30 first engages incline 38, biasing bank 30 upwardly until stud 27 passes into stud receiving opening 39. With stud 27 in stud opening 39, and the guide neans in mating relation, bank 30 is secured to plate 20. For removal, it is necessary to bias bank 30 upwardly until stud 27 clears opening 39 and moves bank 30 away from stud 27. Fin bank 50 is constructed in similar fashion to fin bank 30, though a mirror image, and is, where appropriate, identified with like numbered digits in the series.

Fin banks 40 and 60 are provided with guide slots 47 and 67 which are vertically received along further flanges 45 and 65. Studs 17 and 27 are provided on plates 40 and 60, respectively, to be received within openings 49 and 69 of banks 40 and 60 to secure banks 40 and 60 in place.

Specifically as to the device illustated in FIGS. 1–8, for tenter frame use, top plate 10 defines an elongated opening 12 which is located directly above a like opening 22 defined by bottom plate 20 and through which a web being handled may be visually observed or detected by suitable detection means P. In a most preferred arrangement (See FIGS. 4 and 5), the fin banks 30 and 40 associated with bottom plate 20 are separated by opening 22 defined by plate 20. Fins 32 of bank 30 adjacent an entrance to the device, are spaced apart from adjacent fins 32 by an amount adequate to accept and begin to remove curl, folds, creases and the like from a generally heavy type web, whereas fins 42 of bank 40 are spaced apart from adjacent fins 42 by a lesser amount, adequate to further remove curl, folds, creases and the like from either a light of flimsy web or from a heavy web from which most of the curl has already been removed by the wide spaced entry fins. As mentioned hereinbefore, a common spacing between fins throughout a decurler is illustrated in U.S. Pat. No. 4,217,682. Commercially, a certain spacing between all of the fins of a decurler has been provided when the decurler is intended primarily for use on heavy type webs, with a lesser spacing between all the fins of a decurler intended for use on light or flimsy type webs. While the same approach may be taken for the decurler of the present invention, utilizing a plurality of banks of fins as described, supra, the device of the present invention is generally suitable for handling all types of webs as mentioned above. A like arrangement is provided on the underside of top plate 10 where a first bank of fins 50 is provided adjacent the entrance to the device having a wide spacing between adjacent fins 52 with a second bank of fins 60 being provided adjacent the exit from the decurler having a lesser spacing between fins 62. Such is illustrated in FIG. 5.

Located between top and bottom plates 10 and 20 is an adjustment means generally 70. Adjustment means 70 includes a housing 71 (See FIGS. 5 and 8) that is secured to an underside of top plate 10 and has a plurality of stud receiving openings 72 therethrough, coincident with the number of adjustment studs 76 utilized in the particular device. A portion of the length of openings 72 through housing 71 is threaded at 73 while a further portion of the opening 72 serves as a bearing surface for studs 76 as at 74. One of openings 72 in housing 71 is aligned with an opening 13 defined by top plate 10 for a purpose to be described hereinafter.

A plurality of adjustment studs 76 are received within openings 72 of housing 71, with one adjustment stud 76' extending upwardly through opening 13 of plate 10 and having an adjustment means H illustrated as a handle secured thereto. Studs 76 are threaded along a portion of the length of same at 77 to be received in threaded connection with the threaded portion 73 of openings 72. Beneath the threaded portion 77, a sprocket or other similar means 78 is provided on studs 76 and resides within a recess 79 therefor in housing 71 and in operative association with a drive means 80 as defined thereinafter. Below sprocket 78, studs 76 are received for rotation in bearing surface 74 of housing 71. A lower portion of studs 76 engages a portion of bottom plate 20 with at least certain of studs 76 being received in stud receiving openings 23 located on the inner surface of plate 20. Manually adjustable stud 76' may only make contact with a portion of plate 20. With at least two studs 76 received in respective stud receiving openings 23, lateral movement of plate 10 with respect to plate 20 is precluded.

As illustrated particularly in FIG. 5, in a preferred arrangement, housing 71 is generally triangular shaped, and is located immediately adjacent an edge of plate 10, outside of the path of travel of a web through the device, with each of the studs 76 and 76' being located at a corner of same. Particularly, two studs 76 are located in a line L parallel to an outer end of the device and consequently an outer end of plate 10 while the third, manually adjustable stud 76' is located inwardly with respect to said parallel line and in a line with one of said two studs 76, parallel to the entrance to the decurling device. Line L defines a hinge location for top plate 10 with respect to bottom plate 20, the purpose of which will be described hereinafter. A drive means 80, such as a chain, timing belt or the like passes around sprockets 78 of studs 76 and 76' to interrelate same. When handle H of the manually adjustable stud 76' is rotated to provide adjustment for adjustment stud 76', studs 76 move up or down a like amount such that the positional relationship between the outer web contact surface of the fins associated with plates 10 and 20 may be set at a predetermined position.

In a preferred arrangement for operation of a decurler according to the present invention, there is a slightly greater vertical spacing between the respective fins 32 and 52 at the entrance end of the decurler than at the exit end to facilitate ease of entry of the web W thereinto. Such differential spacing may be preset into the device by particular original placement of the adjustment studs 76 and 76', after which, during adjustment, the preset differential spacing will be retained.

While the innermost stud 76' is disclosed as the adjustment stud for the simultaneous adjustment means 70 of the present decurler, obviously any of the other studs could likewise serve as such. Furthermore, with a chain drive means 80 being received around sprockets 78, in a most preferred embodiment, chain 80 is an inextensible, link chain. Should, however, a drive connector 80 be utilized that is not inextensible, a drive means tension control element 82 shown schematically in phantom in FIG. 5, could be employed. In similar fashion, while sprockets are illustrated as a preferred arrangement for interconnection between the drive means and the invididual studs, sheaves, pulleys or the like could likewise be suitably employed, so long as same could be utilized in conjunction with drive means 80 without slippage.

Figure 8:
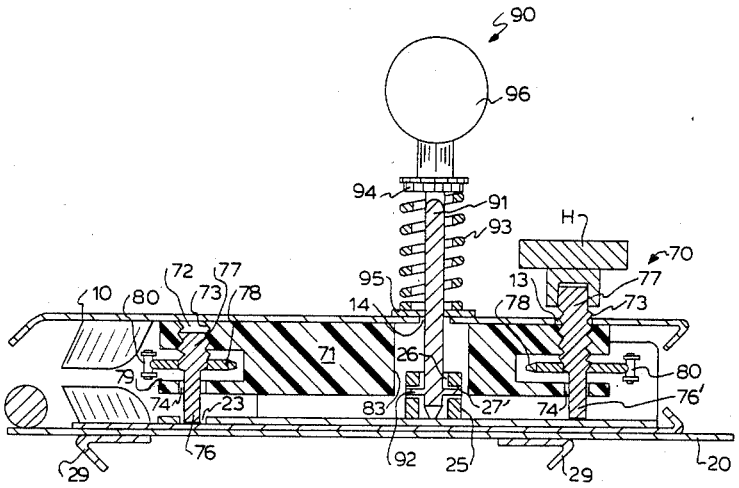
FIG. 8 is a vertical cross sectional view of the device in FIG. 1, taken along a line VIII—VIII.

As illustrated in the Figures, particularly FIG. 8, the quick release coupling means generally indicated as 90 is located within the area of the adjustment means, and is illustrated in Figure 8 as an elongated element 91 that extends through an opening 14 in top plate 10, and an opening 83 in housing 71, and has a latch means 92 located adjacent a terminal end of same. Latch means 92 is preferably a member that extends outwardly from both sides of element 91, transverse to the length of same. A latch receiving means 25 is associated with bottom plate 20 to receive latch means 92 and defines a vertical slot 26 therethrough. Along the length of vertical slot 26 is a cutaway terminating at a shoulder on each side against which latch means 92 may be received against inadvertent removal, whereby top plate 10 may be secured to bottom plate 20 with the adjustment studs 76 being received in the stud receiving means 23. A spring means 93 is located along element 91, between a pair of retainers 94 and 95 to provide a spring bias on latch means 92, holding same against shoulders 27'. As illustrated, an appropriaate handle means 96 is located above the spring neans 93 to facilitate depression and rotational movement of quick release coupling 90.

Latch means 92 is larger than opening 14 in top plate 10 whereby element 91 remains in place with respect to plate 10. When it is desirable to associate decurler plates 10 and 20, the plates are brought into proper alignment such that studs 76 are received in stud receiving means 23 and latch means 92 resides in vertical slot 26 of receiving means 25. Depression of handle 96 of coupling means 90 compresses spring means 93 and moves latch means 92 inwardly of slot 26 of latch receiving means 25. Rotation of element 91 then moves latch means 92 under shoulders 27', and once pressure is removed from handle 96, spring 93 expands applying tension on latch means 92, holding same therein.

Once it is desirable to detach top plate 10 from bottom plate 20, it is simply necessary to again depress handle 96 and rotate same adequate to permit latch means 92 to be returned from shoulders 27' into entrance slot 26. Handle 96 is then released and plate 10 can be moved away from plate 20. With vertical slot 26 aligned as illustrated in the Figures, parallel to an outer edge of the decurler, top plate 10 may be moved laterally away from bottom plate 20 with little or no vertical displacement. Such is advantageous where, for example, in conjunction with a tenter frame, a sensor P is located above the decurler. In this particular arrangement, quick release coupling means 90 is preferably located adjacent the outer edge of the decurling device, beyond the path of travel of the web with no further internal support other than adjustment means 70, such that top plate 10 "floats" above bottom plate 20 to permit separational movement therebetween in the presence of a seam or other imperfection in the web without disrupting the downstream operation of the processing equipment. Specifically, as illustrated in the Figures, coupling means 90 is preferably located along line L (See FIGS. 4 and 5), the general hinge line between plates 10 and 20, whereby top plate 10 floats above bottom plate 20. With coupling means 90 so positioned, no further internal support is generally necessary or desired. Coupling means 90 may, however, be moved off line L, and if the movement of same is of adequate magnitude, or if the weight of top plate 10 dictates, an internal counter spring means such as described in copending application, Ser. No. 273,084, filed June 12, 1981, may be employed.

In further description of the decurler according to teachings of the present invention, certain additional features should be alluded to with respect to top plate 10 and bottom plate 20. With particular reference to FIGS. 1 and 4, a horizontal web support bar 28 is provided adjacent an exit from the decurling device to afford support to a web exiting therefrom without the danger of same being marked or otherwise affected. Bar 28 as can be seen in the Figures extends beyond the end of plate 20, and forms a semi-circle thereat.

Figure 2:
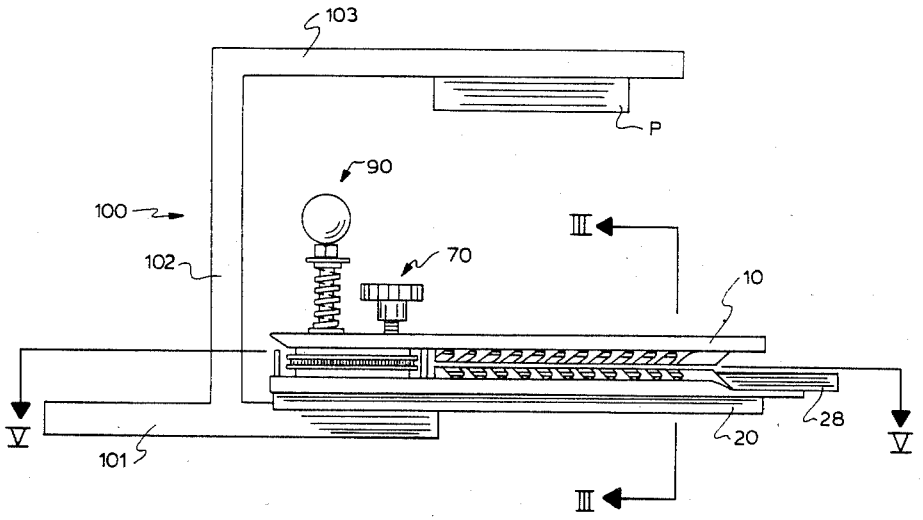
FIG. 2 is a side elevational view of the decurling device as shown in FIG. 1, viewed from the web entrance side of same, and further illustrating a suitable means for mounting the decurling device and a web sensor.

Two types of mounting means are illustrated in FIGS. 2 and 8 for the decurler device according to the present invention. In FIG. 8, for example, a pair of inturned flanges 29 are secured to the outer surface of bottom plate 20, i.e., the surface opposite the surface with which the fins are associated, defining a particular spacing therebetween, such that a support element (not shown) may be received in the space between flanges 29 to securely hold the decurler at a proper location while permitting lateral adjustment along the support to facilitate manual compensation for handling different web widths. In FIG. 2, a mounting means generally indicated at 100 is illustrated having a base 101, a vertical element 102 and a horizontally extending element 103. Base 101 and horizontally extending element 103 are parallel to receive the decurler unit therebetween while a further portion of base 101 extends outwardly from the decurling unit beyond the vertical support 102 and may be utilized to secure the overall structure to the process equipment. Upper horizontal element 103 is so positioned that a detector element such as a photodetector P may be secured thereto being located over plate openings 12 and 22 for detection of a web passing through the decurling device. Should lateral adjustment of the decurling unit be necessary, same may be accomplished by varying the length of the base 101, or by utilizing clamps in conjunction with base 101 to secure the overall structure to the process equipment whereby clamps may be released and the base reclamped at a different location.

Having described the present invention in detail, it is obvious that one skilled in the art will be able to make variations and modifications thereto without departing from the scope of the invention. Accordingly, the scope of the present invention should be determined only by the claims appended hereto.

I claim:

1. A device for removing curl, folds and the like from an edge of a moving web comprising:

(a) a first bank of parallel, elongated fins, said fin bank being of unitary polymeric structure that exhibits a low coefficient of friction, said fins having generally flat outer free edge surfaces and defining a generally pointed apex thereat;

(b) a second bank of parallel, elongated fins, said second bank being of unitary polymeric structure that exhibits a low coefficient of friction and being disposed with respect to said first fin bank to define a web passageway therebetween, fins of said second bank having flat outer free edge surfaces and defining a generally pointed apex thereat; and (c) means for adjustably mounting said banks of fins in said disposition, whereby said flat edge surfaces of said fins of said first and second banks cooperate to remove curl, folds, and the like from a web passing therebetween and whereby the unitary structure permits ease of replacement of an entire bank of fins as a unit.

2. A device as defined in claim 1 wherein said mounting means comprise a pair of operably associable plates, said first fin bank being secured to one of said plates and said second fin bank being secured to the other of said plates.

3. A device as defined in claim 2 wherein one of said plates is removably securable to the other of said plates, and is provided with said adjustment means for adjusting the vertical spacing between said banks of fins.

4. A device as defined in claim 2 wherein said mounting means includes means for securing said banks of fins to said plates.

5. A device as defined in claim 4 wherein one of said plates and said banks is provided with spaced apart track means and the other of said plates and banks define slots that mate with said track means as part of said means for removably securing said fin banks to said plates.

6. A device as defined in claim 5 wherein one of said plates and said banks is provided with a protrusion and the other of said plates and banks defines a protrusion receiving slot.

7. A device as defined in claim 6 wherein the protrusion is located on said plates and the protrusion receiving opening is defined by said banks, and wherein further a beveled surface is provided on said banks adjacent said opening.

8. A device as defined in claim 1 wherein the fin banks are ultra high molecular weight polyethylene.

9. A device for removing curl, folds and the like from an edge of a moving web comprising:

(a) a top plate, said plate having at least one unitary fin bank removably associated therewith, said bank including a plurality of parallel elongated fins disposed at an angle to an edge of a web traveling thereby, said fins each having a flat outer free edge for contact with said web and defining a generally pointed apex thereat, said fins exhibiting a low coefficient of friction;

(b) a bottom plate, said bottom plate having at least one unitary fin bank removably associated therewith, said bank including a plurality of parallel elongated polymeric fins disposed at an angle to an edge of a web traveling thereby, said fins each having a flat outer free edge for contact with said web and defining a generally pointed apex thereat, said fins exhibiting a low coefficient of friction and being located immediately adjacent said fins associated with said top plate;

(c) means to associate said top and bottom plates whereby said top and bottom banks of fins define a web passageway therebetween; and (d) adjustment members located between said top and bottom plate for positionally adjusting the at least one fin bank associated with said top plate relative to the at least one fin bank associated with said bottom plate, said adjustment means comprising a plurality of members, at least certain of which are interrelated such that adjustment of one of said members simultaneously adjusts all of said interrelated members.

10. A device as defined in claim 9 wherein each of said top and bottom plates have a plurality of banks of fins associated therewith, at least one bank of fins adjacent a web entrance to said device having a predetermined lateral spacing between adjacent fins while at least one second bank of fins is provided with a lesser space between adjacent fins.

11. A device as defined in claim 10 wherein said plurality of banks of fins associated with each plate are separated and said top and bottom plates define an opening therein, whereby a web passing therebetween may be detected from a position remote from said device.

12. A device as defined in claim 9 wherein said fins associated with said top and bottom plates are held at a predetermined relative location under spring tension.

13. A device as defined in claim 9 wherein said fins associated with said bottom plate are vertically offset from fins associated with said top plate.

14. A device as defined in claim 13 wherein said fins associated with said top plate and are meshed with fins associated with said bottom plate, whereby a tortuous web passageway is defined therebetween.

15. A device as defined in claim 9 wherein said plate association means are quick release coupling means, whereby said top and bottom plates may be easily disassociated and reassociated for cleaning without disrupting adjacent processing equipment.

16. A device as defined in claim 15 wherein said quick release coupling means comprises an elongated element associated with said top plate to reside above same and to extend through same, and wherein said bottom plate has an element receiving means, said element having a spring means received therealong and located above said top plate, whereby upon alignment of said top and bottom plates, said element may be depressed and rotated into removable engagement against the bias of said spring means to secure said top and bottom plates together.

17. A device as defined in claim 16 wherein said quick release coupling means are located adjacent an edge of said device disposed outside the edge of a web to be treated thereby, whereby the top plate of said device adjacent an end opposite said quick coupling means is not associated with said bottom plate.

18. A device as defined in claim 9 wherein said plurality of adjustment members comprises at least two studs that are associated with one of said plates and extend in a direction toward the other of said plates at which plate same are removably received against horizontal movement, said at least two studs being threaded along a portion of the length of same and having drive means interconnecting same, one of said studs extending through the plate with which it is associated and being adapted for manual rotation thereat, whereby when said one stud is manually rotated to cause same to move in a direction transverse to the plane of said plates, the other of said studs moves a like amount.

19. A device as defined in claim 18 wherein three studs are operatively associated with one of said plates, two of said studs being disposed in a line generally parallel with an outer edge of said plate and the third of said studs being disposed inwardly from said edge in a line generally perpendicular to said edge, and wherein said drive means interconnects said three studs.

20. A device as defined in claim 19 wherein said studs have a sprocket received along the length of same and said drive means is an inextensible chain in operative association with said sprockets.

21. A device as defined in claim 19 wherein tension means are associated with said drive means to ensure simultaneous adjustment of all three studs.

22. A device as defined in claim 19 wherein said three studs are received in a housing secured to an underside of said top plate.

23. A device as defined in claim 22 wherein said innermost stud along said perpendicular line extends through said plate for manual adjustment.

* * * * *